United States Patent [19]

Hudson

[11] 3,937,570

[45] Feb. 10, 1976

[54] CLOUD SUPPRESSION IN AN ELECTROSTATIC COPYING APPARATUS

[75] Inventor: Frederick W. Hudson, West Henrietta, N.Y.

[73] Assignee: Xerox Corporation, Stamford, Conn.

[22] Filed: Nov. 5, 1973

[21] Appl. No.: 412,925

Related U.S. Application Data

[63] Continuation of Ser. No. 149,674, June 3, 1971, abandoned.

[52] U.S. Cl. ..... 355/3 DD

[51] Int. Cl.[2] ..... G03G 15/08

[58] Field of Search ..... 355/3 R, 3 DD, 15, 17; 15/1.5; 118/637

[56] References Cited

UNITED STATES PATENTS

| | | | |
|---|---|---|---|
| 1,349,362 | 8/1920 | Chubb | 55/114 X |
| 3,332,328 | 7/1967 | Roth | 355/3 |
| 3,453,045 | 7/1969 | Fantuzzo | 355/3 DD |
| 3,572,923 | 3/1971 | Fisher et al. | 355/15 |
| 3,580,673 | 5/1971 | Yang | 355/15 |
| 3,633,544 | 1/1972 | Weiler | 118/637 X |
| 3,634,077 | 1/1972 | Sullivan | 355/15 X |
| 3,654,901 | 4/1972 | Donohue et al. | 355/15 |
| 3,791,730 | 2/1974 | Sullivan | 355/3 DD |

*Primary Examiner*—Monroe H. Hayes
*Assistant Examiner*—Kenneth C. Hutchison

[57] ABSTRACT

There is provided an electrostatic copying apparatus having means for delivering a toner material consisting of relatively small particles, a portion of which exist in an air suspension, to an image retention surface for developing a latent image on the surface, a housing for forming with the surface an enclosure for the toner material delivery means, said housing and said surface forming an air gap interface therebetween, and means positioned near said air gap interface for electrostatically precipitating and collecting the toner particles existing in air suspension thereby reducing the flow of particles from the housing through the interface. The toner particles cascaded over the surface are charged to a first polarity opposite to that of the image; the unwanted particles in air suspension have charges of both the first polarity and the opposite polarity. To attract the oppositely charged particles in air suspension the precipitating member, in the form of a roller, is held at a potential of the first polarity — i.e., opposite to the image and the same as the cascading particles. The remaining suspended particles, those of the first polarity, are repelled by the roller and are attracted by the latent image on the surface in the same manner as the cascaded particles.

5 Claims, 4 Drawing Figures

LMPS
LMPI
MOT-6

CLOUD SUPPRESSION IN AN ELECTROSTATIC COPYING APPARATUS

DESCRIPTION OF INVENTION

This is a continuation of application, Ser. No. 149,674 filed June 3, 1971, now abandoned.

This invention relates to copying apparatus. The invention relates more particularly to improvements for enhancing image reproduction in an electrostatic copying apparatus.

In a known form of electrostatic copying apparatus, a latent image is established electrostatically on an image retention element and is developed by passing a toner material over the element. Electrostatic forces cause the toner material to adhere to the surface and to conform to the image. The image is then transferred to a record medium for recording.

In one form of image development, the image retention element comprises a photoconductive surface which is supported on a surface of a rotating drum and a developing material is flowed across the photoconductive element. A typical developer material comprises glass carrier particles which are generally spherically shaped and toner particles of relatively much smaller dimensions which adhere to the carrier particles. The toner particles comprise a pigment in a resin binder, the particles generally having a diameter in the range of a few microns. This developer material is deposited in a hopper from which it is supplied to the photoconductive surface by gravity feed. After flowing across the photoconductive surface, the developer material is collected in a sump and conveyed to the hopper for reuse. In practice, a housing is provided which, along with the surface of the rotating drum, encloses the developer components and developer material.

During operation of the apparatus, the developer material is continuously flowed across the drum surface and is reconveyed to the hopper thereby agitating the developer material. This agitation as well as the periodic addition of replenishment material to the sump causes dispersion of the minute toner particles and results in a suspension of the particles in the air within the housing. An air suspension or cloud of toner particles then exists within the developer housing. The moving drum surface, which together with the housing forms an enclosure for the developer, creates an airflow at an interface between the drum and housing. A portion of the suspended toner particles is drawn into the airflow and escapes from the housing at the interface. The toner particles which thus escape are carried in the air stream around the drum and settle on components of the apparatus causing the components to change their characteristics over a period of time. The machine contamination resulting from these particles contributes to degradation of the reproduced image.

Accordingly, it is an object of this invention to provide an improved form of electrostatic copying apparatus.

Another object of the invention is to provide an improved electrostatic copying apparatus which reduces degradation resulting from the existence of a cloud of toner particles.

Another object of the invention is to provide means in an electrostatic copying apparatus for suppressing a cloud of toner particles.

Still another object of the invention is to provide in an electrostatic copying apparatus wherein a cloud of toner particles is created in a developer section of the apparatus, a means for precipitating particles out of air suspension and for collecting the particles.

In accordance with features of this invention there is provided in an electrostatic copying apparatus having means for delivering a toner material to an image retention surface for developing a latent image on the surface, a housing for forming with the surface, an enclosure for the toner material delivery means, said housing and said surface forming an air gap interface therebetween, the toner material consisting of relatively small particles, a portion of which exist in an air suspension, and which escape from the housing through the interface, the improvement comprising means positioned near said air gap interface for electrostatically precipitating and collecting the toner particles existing in air suspension.

These and other objects and features of the invention will become apparent by referring to the following description and to the accompanying drawings wherein.

Figures 1, 4:
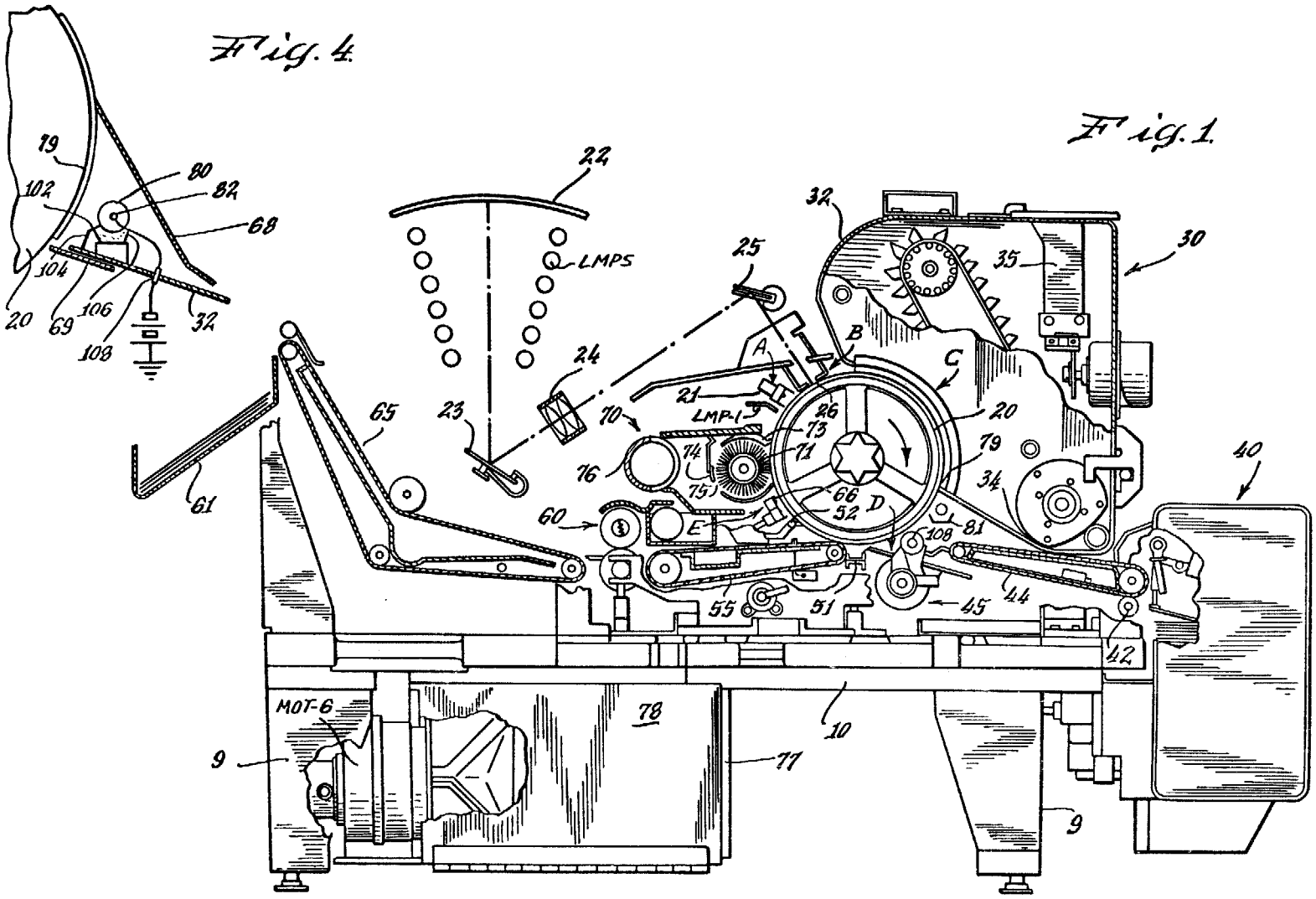
FIG. 1 is a schematic elevation view, partly in section and partly broken away, of a typical electrostatic electrophotographic apparatus having a toner particle suppression means constructed in accordance with features of this invention.
FIG. 4 illustrates an alternative embodiment of the particle precipitating arrangement of FIG. 2 constructed in accordance with features of the invention.

As shown schematically in FIG. 1, the automatic electrostatic electrophotographic reproducing apparatus comprises a photoresponsive surface 20, including a photoconductive layer or light receiving surface on a conductive backing and formed in the shape of a drum, which is mounted on a shaft journaled in a frame to rotate in the direction indicated by the arrow to cause the drum surface sequentially to pass a plurality of electrophotographic processing stations.

For the purpose of the present disclosure, the several electrostatic electrophotographic processing stations in the path of movement of the photoresponsive surface may be described functionally as follows:

A charging station at which a uniform electrostatic charge is deposited on the photoresponsive surface;

An exposure station at which a light or radiation pattern of copy to be reproduced is projected onto the photoresponsive surface to dissipate the charge in the exposed area thereof and thereby form a latent electrostatic image of the copy to be reproduced;

A developing station at which a developing material, including toner particles having an electrostatic charge opposite to that of the electrostatic latent image, is cascaded over the photoresponsive surface whereby the toner particles adhere to the electrostatic latent image to form a powdered image in the configuration of the copy being reproduced;

A transfer station at which the powdered image is electrostatically transferred from the photoresponsive surface to a transfer material or support surface; and, A cleaning and discharge station at which the photoresponsive surface is brushed to remove residual toner articles remaining thereon after image transfer and at which station said surface is exposed to a relatively bright light source to effect substantially complete discharge of any residual electrostatic charge remaining hereon.

The charging station is preferably located as indicated by reference character A. As shown, the charging arrangement includes a corona charging device 21, which includes a corona discharge array of one or more corona discharge electrodes that extend transversely across the photoresponsive surface and are energized from a high potential source and are enclosed within a shielding member.

Next subsequent thereto in the path of motion of the photoresponsive surface is an exposure station B. An optical scanning or projection system is provided to project a flowing image onto the photoresponsive surface from a stationary original.

The optical scanning or projection assembly comprises a stationary copy board which consists of a transparent platen member 22, such as, for example, a glass plate or the like, positioned on the exterior of the cabinet which is adapted to support a document to be reproduced, the document being uniformly illuminated and arranged in light projecting relation to the moving light receiving surface of the electrophotographic drum. Uniform lighting is provided by banks of lamps referenced as LMPS and which are arranged on opposite sides of the copy board. Scanning of the document on the stationary copy board is accomplished by means of a mirror assembly, which is oscillated relative to the copy board, in timed relation to the movement of the said drum.

The mirror assembly, which includes an object mirror 23, is mounted below the copy holder to reflect an image of the document through a lens 24 onto an image mirror 25 which in turn reflects the image onto the drum through a slot in a fixed light shield 26 positioned adjacent to the drum surface.

Adjacent to the exposure station is a developing station C, in which there is positioned a developer apparatus 30, including a casing or housing having a lower or sump portion for accumulating developer material. A bucket type conveyor is used to carry the developing material to the upper part of the developer housing where it is cascaded over a hopper chute onto the photoresponsive surface to effect development. A toner dispenser 35 is used to accurately meter toner to the developing material as toner particles are consumed during the developing operation.

Positioned next and adjacent to the developing station is the image transfer station D which includes a sheet feeding arrangement adapted to feed sheets of support material, such as paper or the like, successively to the electrophotographic drum in coordination with the presentation of the developed image on the drum surface at the transfer station.

The sheet feeding mechanism includes a sheet feed device 40 adapted by means of vacuum feeders to feed the top sheet of a stack of sheets on a tray to rollers 42 which advance the sheets sufficiently to be held by a paper transport 44 which, in turn, conveys the sheet to a sheet registration device 45 positioned adjacent to the drum. The sheet registration device arrests and aligns each individual sheet of material and then in timed relation with the movement of the drum advances the sheet material into contact with the drum in registration with a previously formed powder image on the drum.

The transfer of the powder image from the drum surface to the sheets of the support material is effected by means of the corona transfer device 51 that is located at or immediately after the line of contact between the support material and the rotating drum. In operation, the electrostatic field created by the corona transfer device is effective to tack the support material electrostatically to the drum surface, whereby the support material moves synchronously with the drum while in contact therewith. Simultaneously with the tacking action, the electrostatic field is effective to attract the toner particles comprising the powder image from the drum surface and cause them to adhere electrostatically to the surface of the support material.

Immediately subsequent to the image transfer station, there is positioned a stripping apparatus or paper pick-off mechanism 52 for removing the sheets of support material from the drum surface. This device, which is to the type disclosed in Rutkus et al, U.S. Pat. No. 3,062,536, includes a plurality of small diameter orifices supplied with pressurized aeriform fluid by a suitable pulsator or other device. The pulsator is adapted to force jets of pressurized aeriform fluid through the outlet orifices into contact with the surface of the electrophotographic drum slightly in advance of the sheet, thereby directing the sheet onto an endless conveyor 55 whereby the sheet material is carried to a fixing device 60. At the fixing device, the transferred powder image on the sheet of support material is permanently fixed or fused thereto as by heat. After fusing, the reproduction is discharged from the apparatus at a suitable point for collection externally of the apparatus by means of the conveyor 65. In the embodiment shown the reproductions are discharged from the conveyor 65 into a receiving tray 61.

The next and final station in the device is a drum cleaning station E, having positioned therein a corona preclean device 66 a drum cleaning device 70 adapted to remove any powder remaining on the drum after transfer by means of a rotating brush 71, and a discharge lamp referenced as LMP-1 adapted to flood the photoresponsive surface with light to cause dissipation of any residual electric charge remaining on said surface.

To remove residual powder from the drum, there is disposed a cylindrical brush 71 rotatably mounted on an axle and driven by a motor, not shown. For collecting powder particles removed from the drum by the brush, there is provided a dust hood 73 that is formed to encompass approximately two-thrids of the brush area. To ensure thorough cleaning of the brush, a flicking bar 74 is secured to the interior of the dust hood adjacent the edge of the outlet duct 75 of the dust hood and in interfering relation with the ends of the brush bristles whereby dust particles may be dislodged therefrom.

For removing dust particles from the brush and dust hood, an exhaust duct 76 is arranged to cover the outlet of the dust hood, the exhaust duct being connected at its other end to the wall of a filter box 77 attached to the duct hood. A filter bag 78 is secured within the filter box, with the mouth of the filter bag in communication with the exhaust duct. A motor fan unit referenced as MOT-6 connected to the filter box, produces a flow of air through the filter box drawing air through the area surrounding the drum and the dust hood, the air entraining powder particles removed from the drum by the brush as the air flows through the dust hood. Powder particles are separated from the air as it flows through the filter bag so that only clean air reaches the motor unit.

Suitable drive means are provided to drive the drum, rotating mirror and sheet feed mechanism at predetermined speeds relative to each other, and to effect operation of the bucket-type conveyor and toner dispenser mechanism and the other operating mechanisms.

Though it is believed that the foregoing description is sufficient to show the operation of electrostatographic reproducing apparatus, further details concerning the specific construction can be found in R. F. Osborne et al., U.S. Pat. No. 3,301,126, issued Jan. 31, 1967, and J. E. Cranch et al., U.S. Pat. No. 3,303,817, issued Feb. 14, 1967, the pertinent portions of which are incorporated herein by reference.

Figure 2:
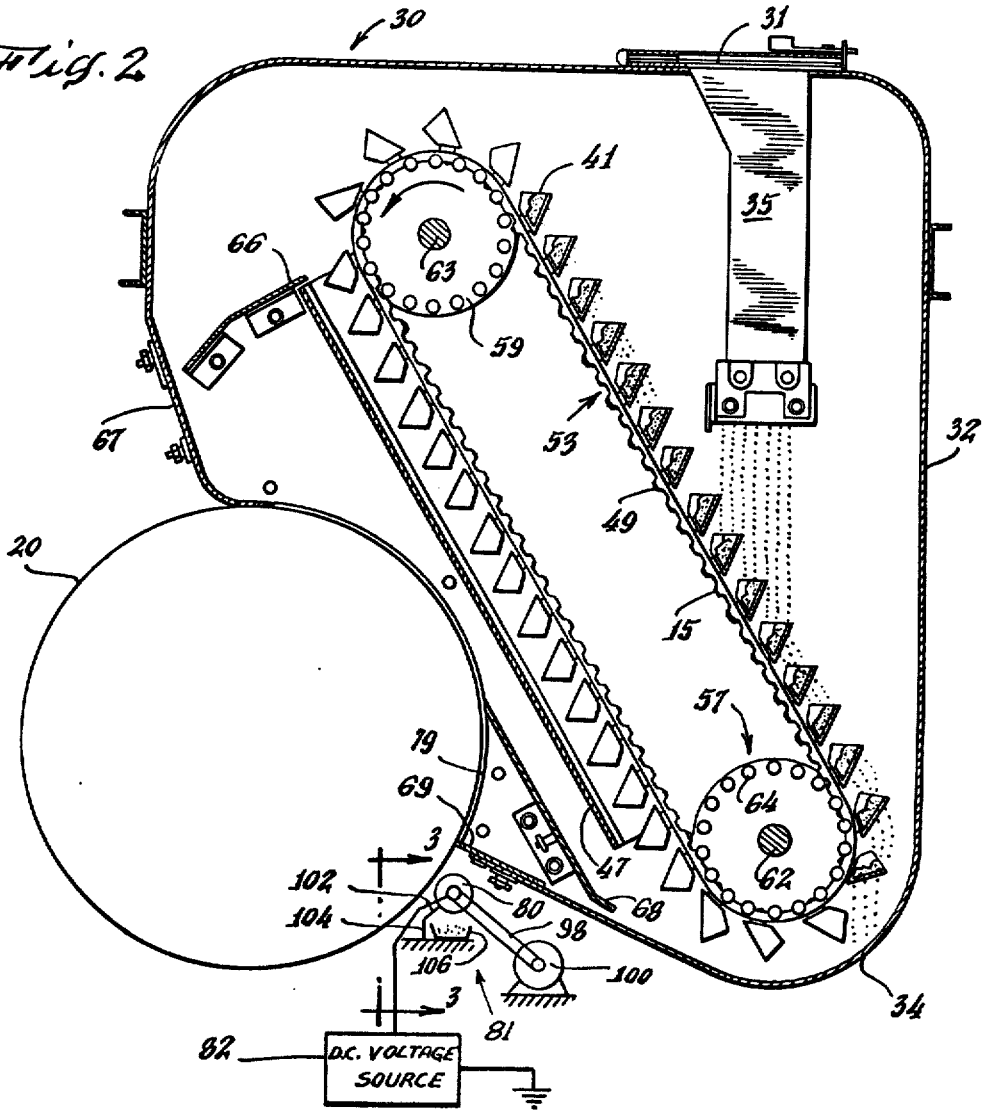
FIG. 2 is an enlarged view of a developer means and its housing which illustrates an embodiment of a toner particle electrostatic precipitating arrangement constructed in accordance with features of this invention.

Turning now to FIG. 2 for a more detailed description of the developing means for the apparatus, it is seen that the developer assembly 30 includes a box-like developer housing having side walls 32 forming in the lower portion thereof a reservoir or sump for development material. As shown in FIG. 2, the sidewalls 32 are formed with a concave edge portion in conformity with the shape of the drum to permit the developer housing to be positioned closely adjacent to the drum. An inclined baffle 47 is secured to the inside faces of the side walls and extends therebetween to limit dust and air currents from circulating within the housing adjacent to the surface of the drum.

A bucket-type conveyor is employed for conveying the developer material from the reservoir portion of the developer housing to the upper portion of the developer housing from which location it is cascaded over the drum. The bucket-type conveyor shown consists of a plurality of parallel spaced buckets 41 secured to an endless conveyor belt 53 which engages conveyor drive pulley 57 and conveyor idler pulley 59. As the conveyor is operated by means of the pulley, the buckets will pick up a charge of developer material previously placed in the bottom or sump portion 34 of the casing and carry this material toward the discharge point 66. The development material is discharged onto a guide plate and in turn is discharged against a chute 67 adjustably secured to the inside of the outer shell or cover of the casing. A pick up plate 68 is secured in position within the developer housing in order to direct developing material that falls from the drum toward the sump 34. A lower pick off plate 69 is adjustably secured to the shell of the housing directly adjacent the drum. This plate is spaced from the surface of the drum by an amount sufficient to permit the toner material which adheres to the drum to pass this station without interference. The spacing of the plate 69 is generally adjusted to a value on the order of .050 inches in order to provide this clearance. An air space interface 79 exists between the housing 32 and drum surface 20.

The continuous agitation of the toner material by the conveyor system as well as the periodic replenishment of the material through the toner dispenser 35 causes dispersion of the minute toner particles thereby resulting in a suspension of these particles in the air within the housing. Because of the relative motion of the drum with respect to the stationary housing 30, an air stream is established near the surface of the drum. The air is swept from the housing at the interface 79 between the drum 20 and the plate segment 69. The air which thus flows from the housing at this point draws with it the toner particles which are suspended in air within the housing. These particles are drawn about the surface of the rotating drum and settle on other components of the apparatus ultimately contaminating and reducing their proper functioning.

Figure 3:
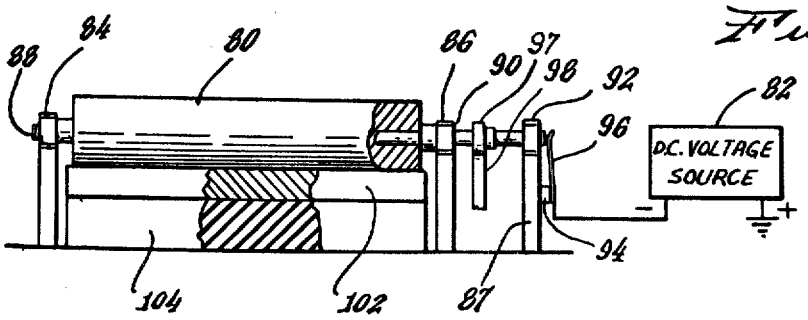
FIG. 3 is an enlarged view, partly in section and partly broken away, taken along line 3—3 of FIG. 2.

In accordance with features of the invention, a means 81 is provided for electrostatically precipitating and collecting the toner particles in air suspension near this interface. FIG. 1 illustrates an embodiment wherein the precipitating and collecting means 81 is positioned external to the developer enclosure. The means which is shown in greater detail in FIG. 2 includes an electrode 80 to which a potential is applied from a DC voltage source 82. Electrode 80 comprises a metal cylinder formed of stainless steel for example and supported on brackets 84 and 86 as illustrated in FIG. 3. The cylinder includes support shaft segments which extend through electrically insulating bearings 88, 90, and 92 thereby insulating the cylinder 80 from ground potential. An electrical insulation block 94 is mounted to the bracket 92 for supporting an electrical contact member 96 which contacts an end surface of the shaft of the cylinder 80. Electrical potential is applied to the shaft 80 from the source 82 for establishing the desired potential on the electrode. A gear 98 is secured to the shaft of cylinder 80 and is driven by a cog belt 98 which is coupled to an electric motor 100. As the drum 20 rotates and the air stream carries the suspended toner particles through the interface, these particles which bear a positive charge will be attracted to and collect on the negatively charged cylinder 80. The particles are thus removed from the air stream thereby inhibiting their passage about the apparatus and reducing particle contamination of the components of the aparatus.

The toner particles collect on the cylinder 80 and after a period of time a thickness of particles will form which will alter the field established by the cylinder. In order to avoid this effect, means are provided for automatically removing the particles from the cylinder 80 and for collecting the same particles. The means for removing the particles comprises a scraping means 102 formed of spring metal, for example, and which is supported on a rigid electrically insulating body 104 in mechanical contact with the surface of the cylinder 80. This mechanical contact and the relative motion between the bodies causes the toner particles to be removed from the surface of the cylinder and to be deposited in a receptacle 106 positioned beneath the cylinder.

In an exemplary arrangement of the embodiment illustrated in FIG. 2, which is not to be construed as limiting the invention in any manner whatsoever, the electrode 80 is formed of a ½ inch diameter stainless steel cylinder to which was applied a D.C. potential in range of −2,000 to −4,000 volts D.C. The cylinder is spaced from the surface of the drum 20 by a distance of .100 inch at a location between the paper idle roller 108 of FIG. 1 and the housing 30 and near the interface 79. Cylinder rotation speeds of 16, 32, 64 and 128 rpm are employed to give satisfactory operating results in the removal of positive charged toner material.

FIG. 4 illustrates an alternative embodiment of the toner material precipitating and collecting arrangement of this invention. In the embodiment of FIG. 4, the electrostatic precipitating means is positioned within the housing 32 near the interface 79 between the drum and the housing plate 69. In FIG. 4, those elenents which perform similar functions as those described with respect to FIG. 2 bear the same reference numerals. In the arrangement of FIG. 4, for purposes of simplification the mechanical mounting means and drive means are not illustrated in detail. It is understood however that such cylinder mounting brackets as described with respect to FIG. 3 can be positioned within the housing 32. Furthermore the cylinder 80 is driven from the conveyor drive shaft 62 and the gearing between the shaft 62 and cylinder 80 is adjusted in order to provide the desired cylinder rpm. Electrical potential is applied to the housing wall through an insulating feed through 108. Operation of this embodiment of the invention is the same in all other respects and access to the precipitating and toner collector components is provided by means of doors not illustrated, formed in the side wall of the housing 32.

In a further embodiment of the invention, the roller precipitating device forms with the drum surface an air gap. The scraping means for the rotating cylinder will comprise the closure for the housing with only the air gap between the roller and drum then remaining.

The embodiments of FIGS. 2, 3 and 4 have been described with respect to toner particles from a cascaded stream of originally negatively charged toner particles forming a cloud in which toner particles exhibit a positive charge and are thereby attracted to the negatively charged electrode 80. These conditions will exist when the latent image being developed exhibits a positive charge and attracts to the surface of the drum negatively charged particles. Those toner particles remaining in air suspension will be generally positively charged and will be attracted to the cylinder 80 by negative potential established thereon. It will be apparent that when an opposite polarity of charge exists for the latent image, then the toner particles in air suspension will be negatively charged and the potential applied to the electrode 80 will be positive in order to precipitate the toner particles in air suspension.

Thus a relatively simple and non-complex arrangement has been described for substantially enhancing the operation of an electrostatic copying apparatus of the type wherein toner particles in air suspension are swept from a housing about the apparatus.

While I have illustrated and described particular embodiments of my invention, it will be understood that various modifications may be made therein without departing from the spirit of the invention and the scope of appended claims.

What is claimed is:

1. In an electrostatic processor including a movable member having a photosensitive surface for carrying latent electrostatic images and an electrically conductive backing for said surface, and a developer housing having means for delivering a developer containing carrier particles and toner particles to said surface to develop said images; said housing and surface being separated by an air-gap interface permitting free movement of said member but otherwise forming an enclosure for said toner delivery means; the improvement comprising precipitator means for suppressing electrically charged airborne toner particles proximate said interface; said precipitator means including an electrode mounted adjacent said interface, means for electrically insulating said electrode from ground, means for applying an electrical potential to said electrode having a polarity opposite to the polarity of said image on said surface and for creating an electrostatic field between said electrode and said backing for urging toner particles of one polarity toward said surface and for attracting toner particles of the opposite polarity to said electrode, and means adjacent said electrode for continuously removing toner particles therefrom.

2. The electrostatic processor of claim 1 wherein said electrode is a rotatable member positioned within said enclosure immediately adjacent said air gap interface and extends coextensively with said air gap interface.

3. The electrostatic processor of claim 2, wherein said rotatable member is a cylinder, and said means for removing toner particles includes a member in mechanical contact with said cylinder.

4. The electrostatic processor of claim 1 wherein said electrode is a rotatable member positioned outside said enclosure immediately adjacent said air gap interface and extends coextensively with said air gap interface.

5. The electrostatic processor of claim 4, wherein said rotatable member is a cylinder, and said means for removing toner particles includes a member in mechanical contact with said cylinder.

* * * * *